United States Patent [19]

Shulman

[11] 4,350,130

[45] Sep. 21, 1982

[54] AIR FUEL MIXTURE CONTROL SYSTEM AND METHOD

[75] Inventor: Michael A. Shulman, Ann Arbor, Mich.

[73] Assignee: Ford Motor Company, Dearborn, Mich.

[21] Appl. No.: 181,916

[22] Filed: Aug. 27, 1980

[51] Int. Cl.[3] ..... F02B 3/08; F02M 7/12

[52] U.S. Cl. ..... 123/440; 123/489

[58] Field of Search ..... 123/440, 489, 478; 60/276, 285

[56] References Cited

U.S. PATENT DOCUMENTS

| | | | |
|---|---|---|---|
| Re. 29,741 | 8/1978 | Norimatsu et al. | 123/440 |
| 3,903,853 | 9/1975 | Kizler et al. | 123/440 |
| 3,939,654 | 2/1976 | Creps | 123/440 |
| 4,073,269 | 2/1978 | Herth et al. | 60/276 |
| 4,075,982 | 2/1978 | Asano et al. | 60/276 |
| 4,099,491 | 7/1978 | Reddy | 60/285 |
| 4,123,999 | 11/1978 | Asano | 123/440 |

*Primary Examiner*—P. S. Lall

*Attorney, Agent, or Firm*—Peter Abolins; Clifford L. Sadler

[57] ABSTRACT

This specification discloses an apparatus and method for controlling the air fuel ratio in an internal combustion engine in response to a signal from an exhaust gas oxygen sensor. A signal proportional to the average air fuel ratio indicated by exhaust gases is integrated to produce a control signal which governs the air fuel ratio. A feedback loop around the integrator provides for an advantageously fast time response of the controller with no over-shoot or instability.

4 Claims, 6 Drawing Figures

FIG. 5

AIR FUEL MIXTURE CONTROL SYSTEM AND METHOD

BACKGROUND OF THE INVENTION (1) Field of the Invention

This invention relates to engine fuel control systems which incorporate an air fuel ratio sensor.

(2) Prior Art

Various fuel control systems are known in the prior art in which the quantity of fuel fed to the engine is controlled by sensors in the exhaust gas which give an indication of the air fuel ratio. Nevertheless, it remains extremely difficult to compensate for the ever changing operating conditions of the engine, the variations among different engines and so on as to always operate the engine with a predetermined air fuel ratio. This drawback may become critical when the engine is equipped with a catalytic converter for reducing undesirable components of the exhaust gases.

A widely used technique to control the air fuel ratio in stoichiometric feedback controlled fuel metering systems is limit cycle integral control. The word "feedback" is used in this context to indicate the use of an air fuel ratio detected in the exhaust gas to govern the air fuel ratio input to the engine. In this technique, there is a constant movement of a fuel metering component in a direction that always tends to counter the instantaneous air fuel ratio indication given by a typical two state exhaust gas oxygen (EGO) sensor. For example, every time an EGO sensor indicates a switch from a rich to a lean air fuel ratio mode of operation, the direction of motion of a typical carburetor's metering rod reverses to create a richer air fuel ratio condition until the sensor indicates a change from a lean to a rich air fuel ratio condition. Then, the direction of motion of the metering rod is reversed again this time to achieve a leaner air fuel ratio condition.

Referring to FIGS. 1*a* and 1*b*, step like changes in the sensor output voltage initiate ramp like changes in the actuator control voltage. When using the limit cycle integral control, the desired air fuel ratio can only be attained on an average basis since the actual air fuel ratio is made to fluctuate in a controlled manner about the average value. The limit cycle integral control system can be characterized as a two-state controller with the mode of operation being either rich or lean. The average deviation from the desired value is a strong function of a parameter called engine transport delay time, $\tau$. This is defined as the time it takes for a change in air fuel ratio, implemented at the fuel metering mechanism, to be recognized at the EGO sensor, after the change has taken place.

The engine transport delay time is a function of the fuel metering system's design, engine speed, air flow, and EGO sensor characteristics. A typical time delay is about 5 to 10 engine revolutions. Because of this delay time, a control system using a limit cycle technique always varies the air fuel ratio about a mean value in a cyclical manner. For example, a richer fuel ratio is typically followed by a leaner air fuel ratio with air fuel ratio overshoots occurring during the transition. The shorter the transport delay time is, the higher will be the frequency of rich to lean and lean to rich air fuel ratio fluctuations and the smaller will be the amplitudes of the air fuel ratio overshoots.

Feedback control of the air fuel ratio is typically necessary to achieve operation in the "window" of a three way catalyst. The window is the chemical composition of the exhaust gas on which the catalyst can act most efficiently to reduce any undesirable exhaust. If a stoichiometry-only air fuel sensor, such as zirconium dioxide sensor, is used, the typical result is the above described limit cycle control in which the air fuel ratio perpetually oscillates about the desired mean control value. That is, the zirconium dioxide sensor just provides an indication of the exhaust air fuel ratio with respect to stoichiometry by having a steep transition in amplitude at the stoichiometric air fuel ratio. However, if a titanium dioxide air fuel sensor is used, proportional control may be accomplished since the titanium dioxide sensor provides information on the magnitude of the air fuel ratio as well as whether the exhaust air fuel ratio is rich or lean of stoichiometry.

The prior art also teaches that a stoichiometry only sensor such as the zirconium dioxide sensor can be used to achieve a type of proportional control. That is, the zirconium dioxide sensor can be used in a way to provide some of the additional information provided by a titanium dioxide sensor. In such a method, the sensor output signal representing the air fuel ratio is modulated with a wave form with an amplitude larger than the signal selecting the air fuel ratio and the feedback is used to control the mean air fuel ratio. One such method uses two air fuel sensors, one on each or half of an engine. For example, in an eight cylinder engine there would be one sensor for each bank of four cylinders.

Due to the aforementioned time delay through the engine, care must be taken in the design of a feedback controller for use with a sensor providing proportional air fuel information. Typically, an integrator with a low gain is used as the control element. As a result, the air fuel ratio in response to a step change in air fuel ratio lasts about five engine transport delay times. If the gain of the integrator is increased to speed the system response, oscillations typically occur since the controller has not accounted for system delay time.

Referring to FIG. 2, a typical air fuel ratio feedback loop is used with a proportional exhaust gas oxygen sensor. Referring to FIG. 3, the sensed air fuel ratio of the system of FIG. 2 is shown as a function of time in response to a step input at time $t=0$ where the time delay is denoted as $T_D$. For the waveform shown in FIG. 3, the gain of the system of FIG. 2 has been adjusted to prevent overshoot. When there is no overshoot, the time for the air fuel ratio to settle down to the desired level is in excess of six time delays. These are some of the problems this invention overcomes.

SUMMARY OF THE INVENTION

This invention recognizes that the controller in a closed loop feedback system can compensate for the transport delay time and achieve a maximum system response with no overshoot. To this end, the controller includes an internal feedback loop around an integrator which takes the output of a proportional air fuel sensor and develops a control signal. Thus, there is an internal feedback loop within the feedback path provided by the controller.

In accordance with an embodiment of this invention, an air fuel mixture control system for an internal combustion engine is coupled to a mixing means for combining air and fuel into an air fuel mixture for an internal combustion engine. The control system is also coupled to an exhaust means for passing exhaust gases from the internal combustion engine. The air fuel mixture control system includes an air fuel sensor means, an integrator means and an internal feedback means. The air fuel sensor means is coupled to the exhaust gas means for providing a signal proportional to the average air fuel ratio. The integrator means has an input coupled to the air fuel sensor means for receiving the average air fuel ratio signal and the output coupled to the mixing means for providing a control signal. The internal feedback means is coupled from the output to the input of the integrator means for governing the output of the controller so as to improve response time to a change in the desired air fuel ratio while reducing overshoot.

DETAILED DESCRIPTION OF THE INVENTION

Figure 1A:
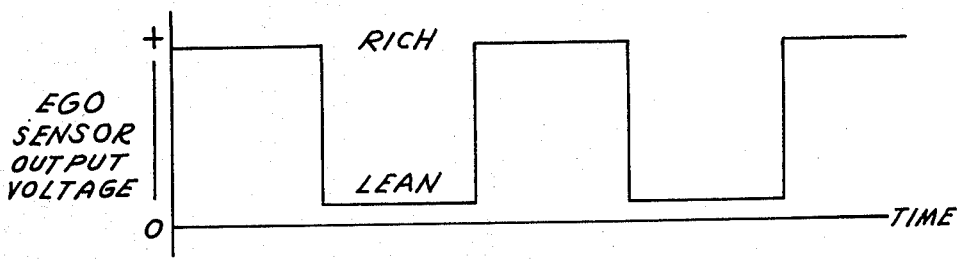
FIG. 1A PRIOR ART
FIG. 1*a* is a graphical representation of the EGO sensor output voltage with respect to time in accordance with a prior art limit cycle control technique.
Figure 1B:
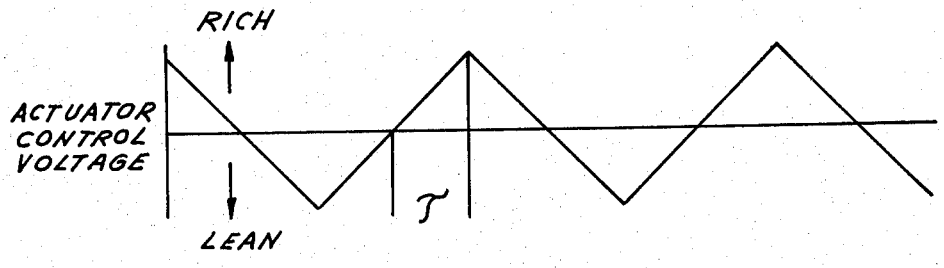
FIG. 1B PRIOR ART
FIG. 1*b* is a graphical representation of the actuator control voltage with respect to time corresponding to the prior art sensor output voltage of FIG. 1*a;*
Figure 2:
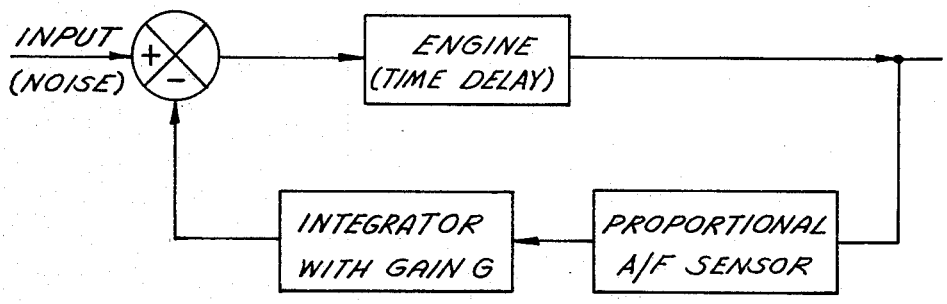
FIG. 2 PRIOR ART
FIG. 2 is a schematic block diagram of a prior art air fuel ratio feedback control loop.
Figure 3:
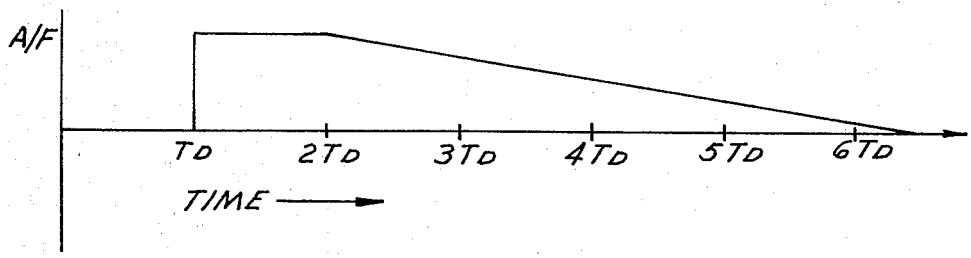
FIG. 3 PRIOR ART
FIG. 3 is a graphical representation of the air fuel ratio change with respect to time of the prior art system of FIG. 2.
Figure 4:
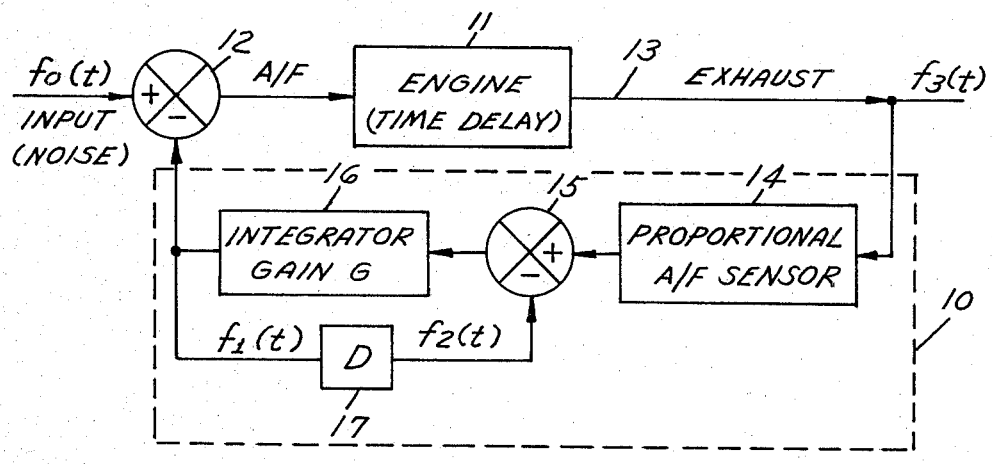
FIG. 4 is a schematic block diagram of an air fuel ratio control system in accordance with an embodiment of this invention.

Referring to FIG. 4, an air fuel ratio controller 10 is coupled in feedback relationship across an internal combustion engine 11 which receives an air fuel ratio from a mixer 12 and produces an exhaust gas in conduit 13. Controller 10 includes a proportional air fuel ratio sensor 14 having an input coupled to conduit 13 and an output coupled to a summer 15. Integrator 16 has an input coupled to summer 15 and an output coupled to mixer 12. A feedback amplifier 17 is coupled from the output of integrator 16 to an input of summer 15. Mixer 12 also receives an input from a desired air fuel ratio setting and undesired system noise. The input to mixer 12 is negative from integrator 16 and positive from the air fuel ratio system set signal.

In operation, feedback amplifier 17 has a gain or amplification, D, so that the output of amplifier 17, $F_2(t)$, is equal to the input to amplifier 17, $F_1(t)$, times the gain D. If $T_D$ is a time delay between the input and the output of the engine, a transfer function for amplifier 17 can be defined by:

$$f_2(t)=DF_1(t)=F_1(t)-F_1(t-T_D)$$

The characterization of the air fuel ratio as defined by the exhaust gases in conduit 13 for a step change in $f_o(t)$ is defined by $F_3(t)$;

$$f_3(t)=f_o(t)\ e[-G(t-2T_D)] \text{ for } t\geqq 2T_D$$

Figure 5:
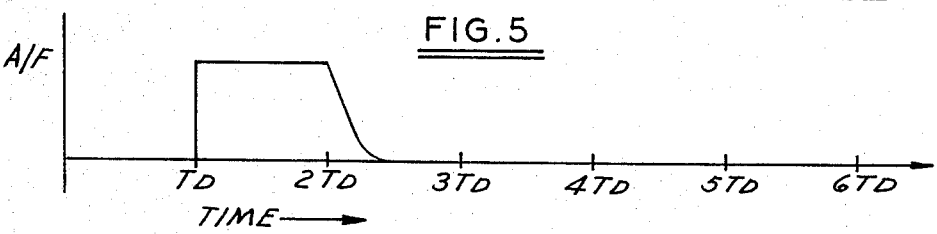
FIG. 5 is a graphical representation of the air fuel ratio with respect to time of the system of FIG. 4 showing a decreased response time in comparison with the prior art system of FIG. 3.

This equation is graphically illustrated at FIG. 5. The air fuel ratio output of mixer 12 is controlled quickly as desired with no overshoot. The feedback cannot control the output of $f_3(t)$ for time less than two times $T_D$. This is so because at time $t=T_D$ the noise is detected and another $T_D$ is required for correction to propogate to the engine output.

The feedback equation characterizing the circuit of FIG. 4 is, in general, $$\frac{1}{G}\ \frac{d}{dt} f_3(t+T_D)+f_3(t+T_D)=\frac{1}{G}\ \frac{d}{dt} f_o(t)+f_o(t)-f_o(t-T_D)$$

If the noise of $f_o$ is sinusoidal, the output of $f_3(t)$ will be, for large gain:

$$f_3(t)=\sin(\lambda t-\phi)-\sin(\lambda t-2\phi)$$

where $\lambda$ is the angular frequency of the noise and $\phi$ is equal to $\lambda$ times $T_D$.

The feedback correction supplied to mixer 12 by the output of integrator 16, is out of phase with the input supplied through a positive input of mixer 12 because of the time delay. If $\phi$ is significant and $\lambda$ is well known, it is possible to retard the feedback correction so that $\phi$ equals $2\pi$ and the feedback completely corrects the noise.

In general, the gain G of integrator 16 is chosen as small as feasible to insure adequate system response. This is done because over a transient driving cycle the actual time delay might differ from that calculated by the controller 10.

A time delay can be implemented using analog components but is more advantageously implemented using a digital component such as a micro computer because of improved ease and accuracy. The input can be sampled, stored in a memory register and then an output value generated a predetermined number of clock pulses later.

Various modifications and variations will no doubt occur to those skilled in the art to which this invention pertains. For example, the particular method of generating a signal proportional to the average air fuel ratio may be varied from that disclosed herein. For example, proportional air fuel sensor 14 may also be implemented by applying various mathematical processing techniques to the output of an air fuel sensor which can sense only whether a particular air fuel ratio is above or below a stoichiometric operating condition. These and all other variations which basically rely on the teachings through which this disclosure has advanced the art are properly considered within the scope of this invention as defined by the appended claims.

I claim:

1. An air fuel mixture control system for an internal combustion engine coupled to a mixing means for combining air and fuel into an air fuel mixture for the internal combustion engine, and an exhaust means for passing exhaust gases from the internal combustion engine, said air fuel mixture control system including:

an air fuel sensor means coupled to the exhaust gas means for providing a signal proportional to the average air fuel ratio;

an integrator means having an input coupled to said air fuel sensor means for receiving said average air fuel ratio signal, and an output coupled to the mixing means for providing a control signal;

a feedback means coupled from said output to said input of said integrator means for governing the output of said control system so as to improve response time to a change in the desired air fuel ratio while reducing the overshoot;

said feedback means having a transfer function defined by $f_2(t)=f_1(t)-f_1(t-T_D)$ wherein $f_2(t)$ is the output of said feedback means at time (t), $f_1(t)$ is the input to said feedback means at time (t), $T_D$ is the time delay between changes initiated in the engine and detected in the exhaust; and said control system being characterized by the equation $$\frac{1}{G}\frac{d}{dt}f_3(t+T_D)+f_3(t+T_D)=\frac{1}{G}\frac{d}{dt}f_o(t)+f_o(t)-f_o(t-T_D)$$

wherein G is the gain of the integrator; $f_o(t)$ is the noise input to the mixing means at time (t); $f_3(t)$ is the output at the exhaust means at time (t).

2. An air fuel mixture control system as recited in claim 1 wherein said air fuel sensor means includes a titanium dioxide sensor which provides an output proportional to the air fuel ratio.

3. An air fuel mixture control system as recited in claim 2 wherein said air fuel means includes:

a zirconium dioxide sensor which provides an indication whether the air fuel ratio is rich or lean of stoichiometry; and an averaging means coupled to the output of said zirconium dioxide sensor for calculating an average air fuel ratio.

4. A method for controlling the air fuel mixture for an internal combustion engine including the steps of:

mixing air and fuel into an air fuel mixture for the internal combustion engine;

passing exhaust gases from the internal combustion engine;

sensing the exhaust gases of the internal combustion engine with a titanium dioxide sensor;

generating an output signal proportional to the average air fuel ratio supplied to the internal combustion engine;

integrating the proportional signal to produce a control signal of governing an air fuel mixture;

feeding back a portion of the integrated control signal to modulate the signal to be integrated thereby improving the response of the control signal to a change in the desired air fuel ratio while reducing undesired overshoot in accordance with a transfer function defined by $f_2(t)=f_1(t)-f_1(t-T_D)$ wherein $f_2(t)$ is the signal being fed back at time (t) to modulate the signal being integrated, $f_1(t)$ is the portion of the integrated control signal being fed back at time (t), and $T_D$ is the time delay between changes initiated in the engine and detected in the exhaust; and said method for controlling the air fuel mixture being in accordance with the equation:

$$\frac{1}{G}\frac{d}{dt}f_3(t+T_D)+f_3(t+T_D)=\frac{1}{G}\frac{d}{dt}f_o(t)+f_o(t)-f_o(t-T_D),$$

wherein G is the gain of the step of integrating, $f_o(t)$ is noise input present at the step of mixing the air and fuel at time (t); and $f_3(t)$ is the output signal at time (t) associated with the step of generating an output proportional to the air fuel mixture.

* * * * *